United States Patent [19]

Ishizuka

[11] Patent Number: 4,501,537

[45] Date of Patent: Feb. 26, 1985

[54] VANE COMPRESSOR HAVING AN ENDLESS CAMMING SURFACE MINIMIZING TORQUE FLUCTUATIONS

[75] Inventor: Yutaka Ishizuka, Saitama, Japan

[73] Assignee: Diesel Kiki Co., Ltd., Tokyo, Japan

[21] Appl. No.: 435,233

[22] Filed: Oct. 19, 1982

[30] Foreign Application Priority Data

Oct. 23, 1981 [JP] Japan ..... 56-169586

[51] Int. Cl.[3] ..... F04C 18/00

[52] U.S. Cl. ..... 418/150; 418/259

[58] Field of Search ..... 418/150, 259

[56] References Cited

U.S. PATENT DOCUMENTS

| | | | |
|---|---|---|---|
| 2,352,941 | 7/1944 | Curtis | 418/150 |
| 2,731,919 | 1/1956 | Predergast | 418/150 |
| 3,717,423 | 2/1973 | Pedersen | 418/150 |
| 3,917,438 | 11/1975 | Glanvall | 418/259 |

*Primary Examiner*—John J. Vrablik
*Assistant Examiner*—John J. McGlew, Jr.
*Attorney, Agent, or Firm*—Frishauf, Holtz, Goodman and Woodward

[57] ABSTRACT

A portion of the endless camming surface of the pump housing, which performs one cycle of suction, compression, and discharge of fluid in cooperation with the vanes and the rotor, includes an increasing radius portion and first through fourth decreasing radius portions successively arranged in the advancing direction of the vanes. These camming surface portions have such cam profiles that with movement of each vane, the amount of protrusion of the vane gradually increases along the increasing radius portion, and gradually decreases along the decreasing radius portions, the receding speed of the vane gradually increasing along the first and third decreasing radius portions, and gradually decreasing along the second and fourth decreasing radius portions. The cam profiles may preferably vary along quadratic curves. Preferably, the above one cycle performing portion further includes one or two constant radius portions located between the above five portions, along which the amount of protrusion of each vane is kept substantially constant with movement of the vane.

28 Claims, 15 Drawing Figures

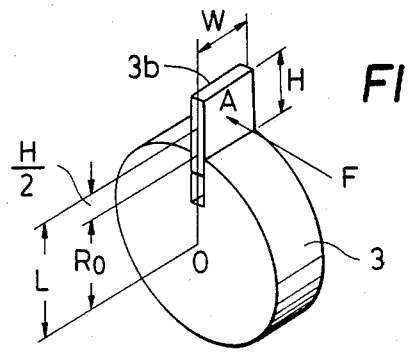
FIG. 3
FIG. 8
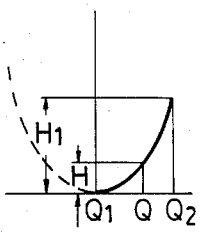
FIG. 9
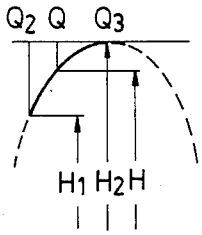
FIG. 10
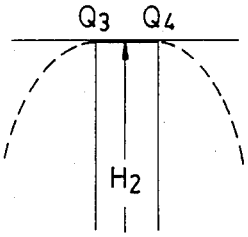
FIG. 11
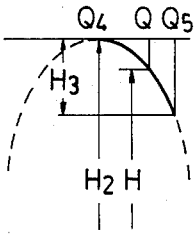
FIG. 12
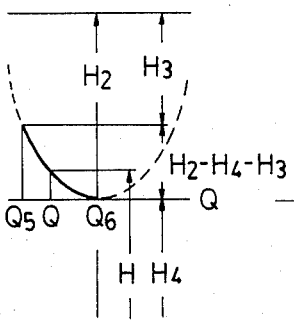
FIG. 13
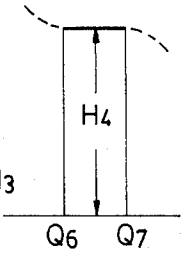
FIG. 14
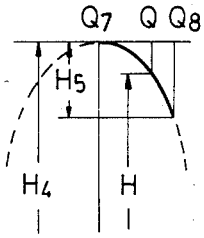
FIG. 15
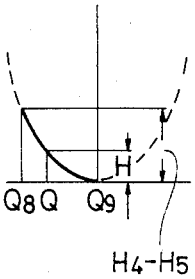

VANE COMPRESSOR HAVING AN ENDLESS CAMMING SURFACE MINIMIZING TORQUE FLUCTUATIONS

BACKGROUND OF THE INVENTION

This invention relates to vane compressors adapted for use in air conditioning systems or the like, and more particularly to vane compressors provided with improved camming surfaces which minimize torque fluctuations.

As known e.g. from U.S. Pat. No. 3,834,846, a vane compressor in general comprises a drive shaft arranged to be rotated by a prime mover, a rotor arranged for rotation in unison with the drive shaft and having an outer peripheral surface formed therein with a plurality of slits, a plurality of vanes radially movably fitted in the slits of the rotor, and a pump housing having an inner peripheral surface formed as an endless camming surface and in which the rotor and the vanes are received. The rotor, the vanes and the pump housing cooperatively define therebetween at least one pumping chamber. As the rotor rotates, gaseous fluid such as refrigerant gas is sucked into the pumping chamber, compressed therein and discharged therefrom.

In the above vane compressor, the endless camming surface of the pump housing, along which the vanes slidingly move in unison with the rotating rotor, has an elliptical cam profile in the type where the pump housing has two pumping chambers defined therein, and a circular cam profile in the type where the pump housing has a single pumping chamber defined therein.

However, conventionally no particular consideration was given to minimizing fluctuations in the torque acting upon the rotor in designing the cam profile of the endless camming surface. Therefore, the conventional vane compressor has large torque fluctuations during each cycle of suction, compression and discharge of fluid, which causes occurrence of operating noise and vibrations of the compressor during operation of the compressor.

OBJECTS AND SUMMARY OF THE INVENTION

It is an object of the invention to provide a vane compressor in which the pum housing has an endless camming surface having a novel cam profile minimizing the torque fluctuations, thus reducing operating noise and vibrations of the compressor.

It is a further object of the invention to provide a vane compressor, in which the pump housing has a novel endless camming surface permitting the vanes to slide thereon, with its sliding contacting pressure kept substantially constant, for positive performance of cycles of suction, compression and discharge of fluid.

According to the present invention, the endless camming surface of the pump housing has at least one portion for performing one cycle of suction, compression and discharge of fluid in cooperation with the vanes and the rotor, which portion comprises: an increasing radius portion, and first through fourth decreasing radius portions successively arranged in the order mentioned in the moving direction of the vanes. The increasing radius portion has such a cam profile that the amount of protrusion of each vane from the rotor gradually increases with movement of the vane along the same portion. Preferably, the increasing radius portion comprises a first portion and a second portion which have such cam profiles that the distance between the camming surfaces of these portions and the center of the rotor varies along quadratic curves. The first through fourth decreasing radius portions have such cam profiles that the amount of protrusion of each vane gradually decreases with movement of the vane along these portions, the receding velocity of the vane gradually increasing along the first and third decreasing radius portions, and decreasing along the second and fourth portions, respectively. Preferably, the decreasing radius portions have such cam profiles that the distance between the camming surfaces of these portions and the center of the rotor varies along quadratic curves.

The first and second decreasing radius portions are located at least in part in a rotational angle region of the rotor where fluid pressure acting upon a portion of each vane protruded from the rotor rapidly increases with movement of the vane along the same region.

Preferably, the above one cycle performing portion of the endless camming surface further includes at least one of: a first constant radius portion located between the increasing radius portion and the first decreasing portion, and along which the amount of protrusion of each vane from the rotor is kept substantially constant with movement of the vane, a second constant radius portion located between the second decreasing radius portion and the third decreasing radius portion, and along which the amount of protrusion of each vane from the rotor is kept substantially constant with movement of the vane, and a third constant radius portion arranged either at a location immediately preceding the increasing radius portion or at a location immediately following the fourth decreasing radius portion in the moving direction of the vane, and along which sealing is effected between the rotor and the pump housing.

The above and other objects, features and advantages of the invention will be more apparent from the ensuing detailed description taken in connection with the accompanying drawings.

BRIEF DESCRIPTION OF THE DRAWINGS

FIG. 3 is a schematic view showing the rotor and a vane of a vane compressor for explanation of torque acting upon the rotor;

FIG. 8 is a graph showing the relationship between the amount H of protrusion of a vane and the rotational angle Q, obtained when the vane moves along a first increasing radius portion having a quadratic cam profile of the camming surface according to the present invention;

FIG. 9 is a graph similar to FIG. 8, obtained by the vane moving along a second increasing radius portion having a quadratic cam profile of the camming surface of the present invention;

FIG. 10 is a graph similar to FIG. 8, obtained by the vane moving along a first constant radius portion of the camming surface of the present invention;

FIG. 11 is a graph similar to FIG. 8, obtained by the vane moving along a first decreasing radius portion having a quadratic cam profile of the camming surface of the present invention;

FIG. 12 is a graph similar to FIG. 8, obtained by the vane moving along a second decreasing radius portion having a quadratic cam profile of the camming surface of the present invention;

FIG. 13 is a graph similar to FIG. 8, obtained by the vane moving along a second constant radius portion of the camming surface of the present invention;

FIG. 14 is a graph similar to FIG. 8, obtained by the vane moving along a third decreasing radius portion having a quadratic cam profile of the camming surface of the present invention; and FIG. 15 is a graph similar to FIG. 8, obtained by the vane moving along a fourth decreasing radius portion having a quadratic cam profile of the camming surface of the present invention.

DETAILED DESCRIPTION

Figure 1:
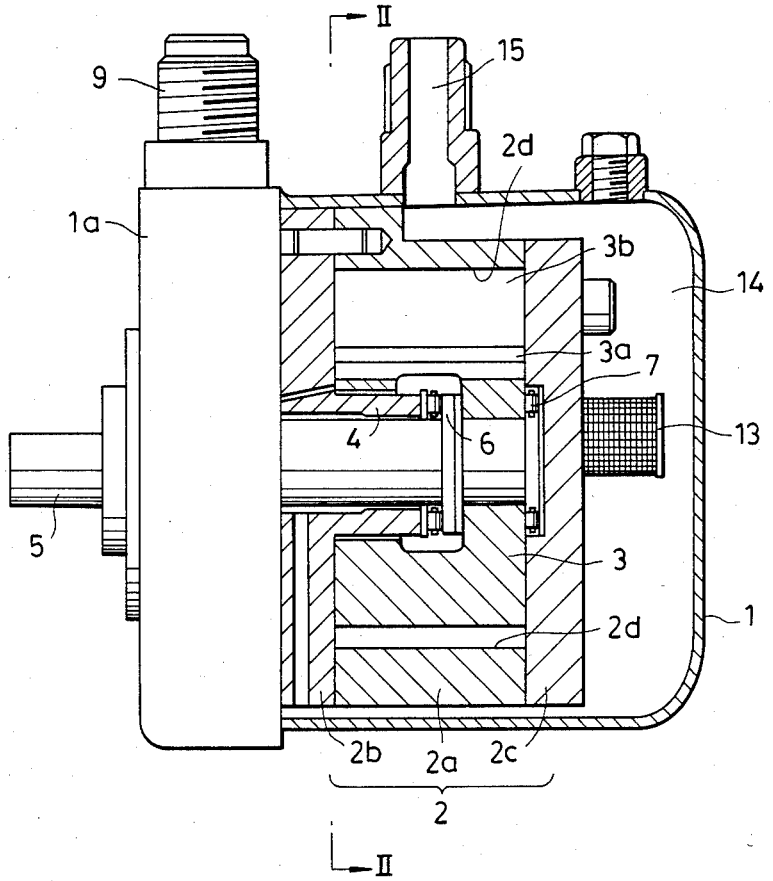
FIG. 1 is a side view of a typical conventional vane compressor of the double pumping chamber type, with its essential part shown in longitudinal section.
Figure 2:
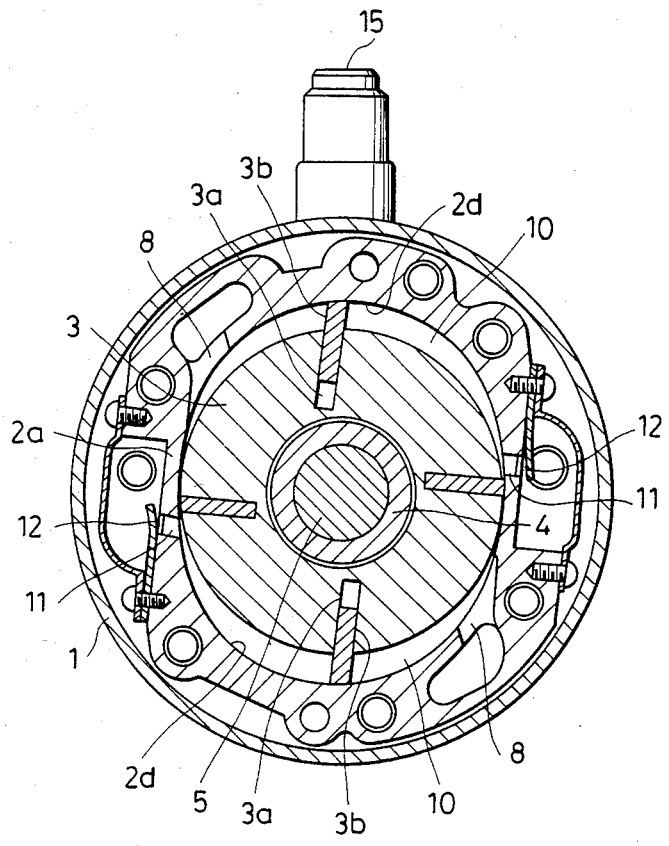
FIG. 2 is a sectional view taken along line II—II in FIG. 1.

Referring to FIGS. 1 and 2, there is illustrated a typical conventional vane compressor having two pumping chambers. A pump housing 2 is enclosed by an outer shell 1, which housing is formed by a cam ring 2*a*, a front side block 2*b* and a rear side block 2*c*. The cam ring 2*a* has its inner peripheral surface 2*d* acting as a camming surface. Rotatably fitted in the pump housing 2 is a cylindrical rotor 3 which has its peripheral surface formed therein with a plurality of axial slits 3*a* and carries a plurality of plate-like vanes 3*b* radially movably fitted in the respective slits 3*a*. The rotor 3 is securedly fitted on an inner end of a drive shaft 5 rotatably supportedly extending through a bearing portion 4 formed integrally on the front side block 2*b*. The drive shaft 5 has a radial flange 5*a* formed integrally at its inner end and axially bearing against the inner end face of the bearing portion 4 by means of a thrust bearing 6, whereas the rotor 3 axially bears against the inner surface of the rear side block 2*c* by means of a thrust bearing 7. With this arrangement, as the drive shaft 5 rotates, the rotor 3 is rotated in unison with the drive shaft 5. Centrifugal force produced by the rotation of the rotor 3 and back pressure of lubricant oil acting upon the vanes 3*b* at the bottoms of the slits 3*a* cooperate to radially outwardly force the vanes 3*b* into sliding contact at their tips with the camming peripheral surface 2*d*. Thus, the vanes 3*b* are slidingly moved along the camming inner peripheral surface 2*d* in a clockwise circumferential direction as viewed in FIG. 2, in unison with the rotating rotor 3. Each time one of the vanes 3*b* passes by a pump inlet 8 formed in the inner peripheral surface of the cam ring 2*a*, compressing fluid is sucked into a pumping chamber 10 defined by adjacent vanes 3*b*, the camming inner peripheral surface 2*d* and the inner surfaces of the side blocks 2*b*, 2*c*, through a suction connector 9 provided on a front head 1*a*. Each pumping chamber 10 has its spatial volume varying from a minimum value to a maximum value during the suction stroke, and varying from a miximum value to a minimum value during the compression stroke. The fluid thus sucked into the chamber 10 and compressed therein is discharged through a pump outlet 11 and a discharge valve 12 forcedly opened by the compressed fluid. The above operating cycle is repeatedly carried out. The compressed fluid is discharged into a delivery pressure chamber 14 defined between the pump housing 12 and the outer shell 1, after having lubricant oil mixed therein separated therefrom by a lubricant oil separator 13, and then is delivered through a discharge connector 15 into an external circuit, not shown, after temporary staying in the chamber 14.

In the vane compressor having the above-described arrangement and operation, the camming inner peripheral surface 2*d* of the cam ring 2*a* has an elliptical cam profile in the double pumping chamber type, and a circular cam profile in the single pumping chamber type. Since these cam profiles are not specially adapted for reducing the torque fluctuations, the compressor undergoes large torque fluctuations during each cycle of suction, compression and discharge of fluid, resulting in the occurrence of operating noise and vibrations of the compressor.

I have made studies regarding torque fluctuations occurring in the conventional vane compressor, to reach the following recognition: First, the torque T acting upon the rotor 3 of the vane compressor is equal to the product of the force F applied to the vane 3*b* and the lever length L (the distance between the point of application of the force F to the vane and the center of the rotor 3) and therefore can be represented by an equation $T=F \cdot L$. While, the torque T is represented by the following equation:

$$\begin{aligned} T &= F \cdot L \\ &= P \cdot A \cdot L \\ &= W \cdot P \cdot (RoH + H^2/2) \end{aligned} \quad (1)$$

where

P = the fluid pressure acting upon the vane 3*b*,

A = the area of a portion of the vane 3*b* protruded from the rotor 3,

W = the width of the vane 3*b*,

H = the amount of protrusion of the vane 3*b* or radial length of the portion of the vane 3*b* protruded from the rotor 3, and Ro = the radius of the rotor 3.

In a conventional vane compressor of the double pumping chamber type having an elliptical cam profile, for instance, the one cycle performing portion of the camming inner peripheral surface 2*d* comprises a former half region along which the amount H of protrusion of the vane from the rotor gradually increases with the increase of the rotational angle Q of each vane 3*b* (the angle at which tip of each vane 3*b* lies apart from the starting end of the one cycle performing portion with respect to the center of the rotor 3), and a latter half region along which the vane protruding amount H gradually decreases with the increases of the rotational angle Q. The fluid pressure P rapidly increases to a very high value at the terminating end portion of the above former half region which corresponds to a latter half portion of the compression stroke. Therefore, at the latter half portion of the compression stroke where the vane protruding amount H and the fluid pressure P both increase, the torque T rapidly increases up to a peak value, as will be understood from the aforementioned equation (1). As a consequence, in the conventional vane compressor, there occurs a large and abrupt change in the torque with respect to the rotational angle Q, as indicated by the break line in FIG. 6.

I have also made tests based upon the above recognition, to reach the following finding: A portion of the camming surface 2*d* which performs one cycle of suction, compression and discharge of fluid in cooperation with the vanes and the rotor, should include:

(1) an increasing radius portion having such a cam profile that the amount of protrusion of each vane gradually increases, with movement of the vane;

(2) a first decreasing radius portion having such a cam profile that the vane protruding amount gradually decreases, while simultaneously the receding velocity of the vane gradually increases, with movement of the vane along the same portion;

(3) a second decreasing radius portion having such a cam profile that the vane protruding amount gradually decreases, while simultaneously the receding velocity of the vane gradually decreases, with movement of the vane along the same portion;

(4) a third decreasing radius portion having such a cam profile that the vane protruding amount gradually decreases, while simultaneously the receding velocity of the vane gradually increases, with movement of the vane along the same portion; and (5) a fourth decreasing radius portion having such a cam profile that the vane protruding amount gradually decreases, while simultaneously the receding velocity of the vane gradually decreases, with movement of the vane along the same portion.

The above five portions should be arranged in the above-mentioned order in the moving direction of the vane.

The incresing radius portion should preferably be located so as to perform the whole suction stroke and a former half portion of the compression stroke, to thereby promote the increase of the fluid pressure, that is, the increase of the torque. The first decreasing radius portion should preferably be located so as to perform a latter half portion of the compression stroke, whereby the vane protruding amount is decreased so as to restrain a rapid increase in the torque which would otherwise be caused by a rapid increase in the fluid pressure. The second decreasing radius portion should preferably be located so as to perform the latter half portion of the compression stroke and a former half portion of the discharge stroke, to thereby avoid an excessive decrease in the vane protruding amount which would otherwise be caused by further application of the first decreasing radius portion. The provision of the first and second decreasing radius portions broadens the compression stroke so as to extend over a wide rotational angle range. Also, if the terminating end of the second decreasing radius portion has such a cam profile as to reduce the receding velocity of the vane to zero, the vane protruding amount is kept constant throughout the discharge stroke where the fluid pressure remains substantially constant, thus, maintaining the torque substantially constant. The third and fourth decreasing radius portions should preferably be located so as to perform a latter half portion of the discharge stroke, so that the third decreasing radius portion serves to rapidly reduce the vane protruding amount which has been maintained substantially constant at the terminating end portion of the second decreasing radius portion, and then the fourth decreasing radius portion serves to reduce the vane protruding amount to zero while reducing the receding velocity of the vane, for smooth transition to the suction stroke of the next cycle. By virtue of the above five different portions arranged above, the fluctuations in the torque acting upon the rotor can be minimized.

Further, vane compressors should desirably satisfy another requirement that each vane 3*b* can slidingly move along the camming inner peripheral surface 2*d* while its tip is permanently kept in tight contact with the camming peripheral surface 2*d*. To meet this requirement, it is necessary to maintain constant the contact pressure of the vane 3*b* against the camming inner peripheral surface 2*d*. I have made further studies and experiments in order to solve this problem, and reached the conclusion that the above contact pressure can be maintained substantially constant by controlling the vane protruding amount so as to keep constant the centrifugal acceleration of the vane 3*b* in the radial direction of the rotor, and this can be attained by designing the camming inner peripheral surface 2*d* to have such a cam profile that the distance between the camming inner peripheral surface and the center of the rotor varies along quadratic curves. More specifically, if a portion of the camming inner peripheral surface 2*d* is designed to have a quadratically curved profile, the vane protruding amount H at that portion can be represented by a quadratic function of the rotational angle Q, for instance, by an equation of $H=A(Q-Q_0)^2$, provided that A and $Q_0$ are constants, and the acceleration of the vane 3*b* in the radial direction of the rotor can be represented by an equation of $d^2H/dt^2=2A(dQ/dt)^2$, where dQ/dt represents the rotational speed of the rotor. If it is assumed that dQ/dt has a constant value, the acceleration of the vane 3*b* in the radial direction of the rotor is constant, so that the contact pressure of the vane 3*b* against the camming inner peripheral surface 2*d* is constant.

Figure 4:
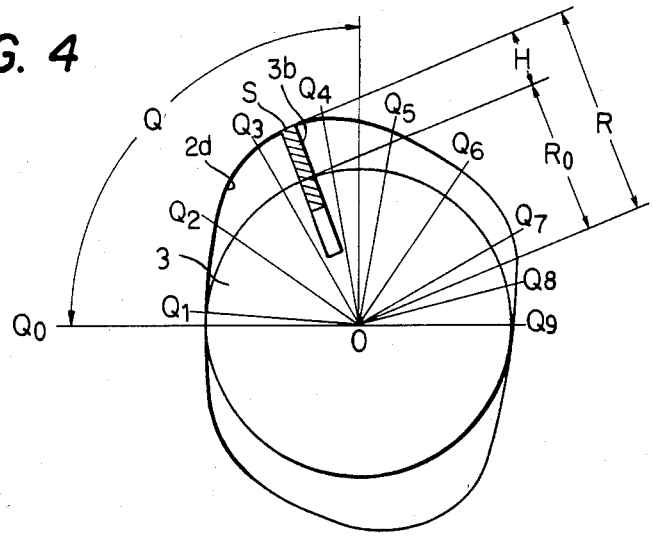
FIG. 4 is a view showing symbols used for description of the rotor and the endless camming surface of the vane compressor.
Figure 5:
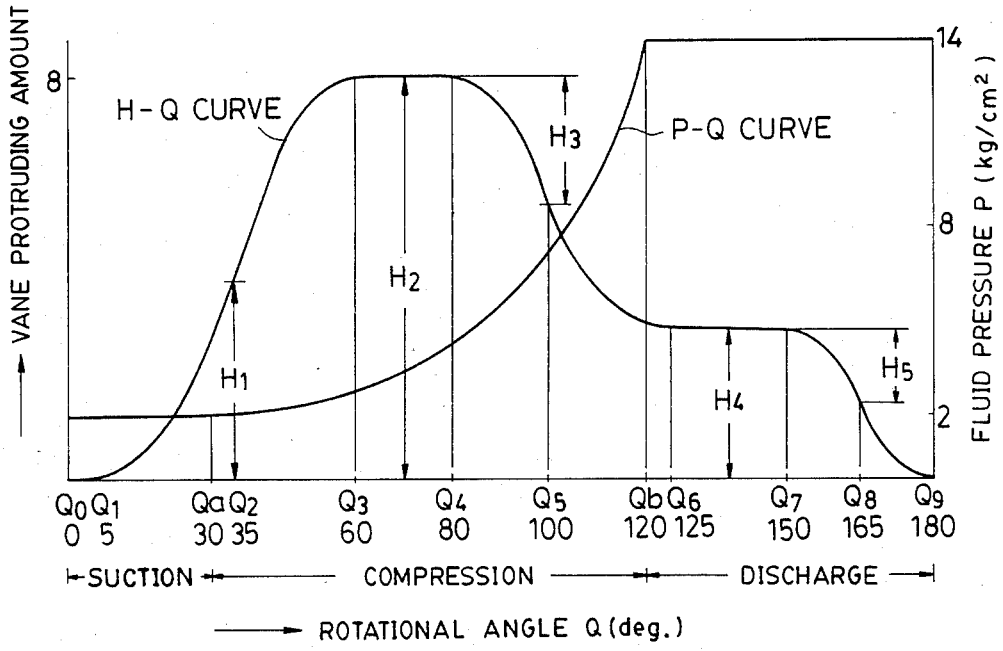
FIG. 5 is a graph showing a H-Q curve representing the relationship between the rotational angle Q and the vane protruding amount H in one cycle, and a P-Q curve representing the relationship between the rotational angle Q and fluid pressure P acting upon a vane, obtained by an endless camming surface according to one embodiment of the present invention.

An embodiment of the present invention will now be described with reference to FIGS. 4 through 15, which is applied to a vane compressor of the double pumping chamber type. Vane compressors to which the invention is applicable, including the present embodiment, are substantially identical in construction with the conventional vane compressor shown in FIGS. 1 and 2, except for the cam profile of the endless camming inner peripheral surface. Therefore, description of the other parts of the compressor of the embodiment than the camming peripheral surface is omitted here. Referring first to FIG. 4, there are shown symbols which will be used in the description given below. Symbols O, Ro, R and H designate, respectively, the center of the rotor 3, the radius of the rotor 3, the distance between the center O of the rotor 3 and the camming inner peripheral surface 2*d*, and the vane protruding amount. Symbols $Q_0$ through $Q_9$ represent circumferential positions corresponding to the boundaries between various curved portions forming the camming inner peripheral surface 2*d*. The rotational angle Q of the vane 3*b* represents the angle at which tip of the vane 3*b* lies apart from the starting end of the one cycle performing portion of the camming inner peripheral surface *2d*, with respect to the center O of the rotor 3. In the present embodiment applied to the double pumping chamber type, each operating cycle of suction, compression and discharge of fluid is completely carried out along the semispherical portion $Q_0$–$Q_9$ circumferentially extending through 180 degrees, so that two such cycles are performed during one rotation of the rotor 3. A portion of the camming inner peripheral surface *2d* for performing one operating cycle, which circumferentially extends through 180 degrees, preferably comprises a combination of the below-mentioned curved surface elements. Two such identical combinations are arranged along the whole circumference or endless camming inner peripheral surface *2d*, in a manner symmetrical with respect to the center O of the rotor 3. In FIG. 5, one of the combinations of the curved surface elements is graphically represented by a H-Q curve, wherein the rotational angle Q is taken as abscissa, and the vane protruding amount H (mm) as ordinate, respectively:

(1) First Regularly Circular Portion $Q_0Q_1$, along which the rotor 3 and the camming inner peripheral surface *2d* are in face-to-face contact with each other: At this portion, $0° \leqq Q \leqq Q_1$, and $H=0$;

(2) First Increasing Radius Portion $Q_1Q_2$, at which the protruding velocity of the vane *3b* gradually increases: At this portion, $Q_1 < Q \leqq Q_2$, and H increases from O to $H_1$, $H_1$ representing the vane protruding amount at the terminating end of the present portion $Q_1Q_2$;

(3) Second Increasing Radius Portion $Q_2Q_3$, along which the protruding velocity of the vane *3b* gradually decreases: At this portion, $Q_2 < Q \leqq Q_3$, and H increases from $H_1$ to $H_2$, $H_2$ representing the vane protruding amount at the terminating end of the present portion $Q_2Q_3$;

(4) First Constant Radius Portion $Q_3Q_4$, along which the protruding amount of the vane *3b* is kept constant: At this portion, $Q_3 < Q \leqq Q_4$, and $H=H_2$;

(5) First Decreasing Radius Portion $Q_4Q_5$, along which the receding velocity of the vane *3b* gradually increases: At this portion, $Q_4 < Q \leqq Q_5$, and H decreases from $H_2$ to $(H_2-H_3)$, $H_3$ representing the amount by which vane recedes into the rotor as it moves from the starting end of this portion to the terminating end of same;

(6) Second Decreasing Radius Portion $Q_5Q_6$, along which the receding velocity of the vane *3b* gradually decreases: At this portion, $Q_5 < Q \leqq Q_6$, and H decreases from $(H_2-H_3)$ to $H_4$, $H_4$ representing the vane protruding amount at the terminating end of this portion;

(7) Second Constant Radius Portion $Q_6Q_7$, along which the vane protruding amount is kept constant: At this portion, $Q_6 < Q \leqq Q_7$, and $H=H_4$;

(8) Third Decreasing Radius Portion $Q_7Q_8$, along which the receding velocity of the vane *3b* gradually increases: At this portion, $Q_7 < Q_{23}Q_8$, and H decreases from $H_4$ to $(H_4-H_5)$, $H_5$ representing the amount by which the vane recedes into the rotor as it moves from the starting end of this portion to the terminating end of same; and (9) Fourth Decreasing Radius Portion $Q_8Q_9$, along which the receding velocity of the vane *3b* gradually decreases: At this portion, $Q_8 < Q \leqq Q_9$, and H decreases from $(H_4-H_5)$ to 0.

In FIG. 5, symbol *Qa* denotes the rotational angle at which the suction stroke is terminated, and *Qb* the rotational angle at which the discharge stroke is started, respectively. Thus, $(Qa-Qb)$ represents the compression stroke.

The above curved surface elements individually circumferentially extend through the following respective angles:

(1) Regularly Circuit Portion $Q_0Q_1$: $0° \leqq Q_1-Q_0=Q_1 \leqq 10°$;

(2) First and Second Increasing Radius Portions $Q_1Q_3$: $45° \leqq Q_3-Q_1 \leqq 90°$;

(3) First Constant Radius Portion $Q_3Q_4$: $0° \leqq Q_4-Q_3 \leqq 45°$;

(4) First and Second Decreasing Radius Portions $Q_4Q_6$: $30° \leqq Q_6-Q_4 \leqq 90°$;

(5) Section Constant Radius Portion $Q_6Q_7$: $0° \leqq Q_7-Q_6 \leqq 30°$; and (6) Third and Fourth Decreasing Radius Portions $Q_7Q_9$: $5° < Q_9-Q_7 \leqq 45°$.

Of the above nine curved surface elements, the first and second increasing radius portions $Q_1Q_3$, and the first through fourth decreasing radius portions $Q_4Q_5$, $Q_5Q_6$, $Q_6Q_7$ and $Q_8Q_9$ are essential for achieving the objects of the invention, and are therefore indispensable. The first and second increasing radius portions $Q_1Q_3$have their combined circumferential angle set at a value smaller than 90° as noted above, so as to achieve an advanced timing of the increase of the compression pressure (fluid pressure in the pumping chamber) P in an initial low torque region of one operating cycle. These first and second increasing radius portions $Q_1Q_3$ may have such a cam profile as makes the vane protruding velocity constant along their whole combined circumferential length. However, preferably, they should comprise a first increasing radius portion $Q_1Q_2$ having such a cam profile that the vane protruding velocity gradually increases with movement of the vane along the same portion, and a second increasing radius portion $Q_2Q_3$ having such a cam profile that the vane protruding velocity gradually decreases with movement of the vane along the same portion. The first increasing radius portion $Q_1Q_2$ serves to increase the work to be done by the compressor in the corresponding rotational angle region of the rotor 3 to a larger value than that obtainable by the above-mentioned cam profile making the vane protruding velocity constant, to thereby promote the increase of the compression pressure P and consequently flatten the overall torque curve. More preferably, the first and second increasing radius portions $Q_1Q_3$and $Q_2Q_3$ have their cam profiles configurated in the form of quadratic curves, which can keep the contact pressure of the vane *3b* against the camming inner peripheral surface *2d*.

On the other hand, the first and second decreasing radius portions $Q_4Q_5$ and $Q_5Q_6$ have their cam profiles configurated so as to gradually increase and gradually decrease the receding velocity of the vane *3b*, respectively, with movement of the vane *3b* along these portions. At least part of these decreasing radius portions are arranged in a rotational angle region of the rotor 3 where the fluid pressure P acting upon a portion of the vane protruded from the rotor rapidly or abruptly increases. More specifically, the first decreasing radius portion $Q_4Q_5$ is preferably arranged in a rotational angle region corresponding to a latter half portion of the compression stroke where the fluid pressure P rapidly or abruptly increases, to thereby reduce the vane protruding amount H for restraint of the increase of the torque T which would be caused by the increase of the fluid pressure P. The second decreasing radius portion $Q_5Q_6$ is preferably arranged in a rotational angle region corresponding to the terminating end portion of the compression stroke where the fluid pressure P assumes a maximum value. If the first decreasing radius portion $Q_4Q_5$ were extended even to this last-mentioned rotational angle region, it would result in an excessive receding amount of the vane so that the resultant decrease of the torque T caused by the increased vane receding amount could surpass the increase of the torque T caused by the increase of the fluid pressure P. Consequently, the torque T obtained can have a value below a required value. The second decreasing radius portion $Q_5Q_6$ moderates the above decrease of the torque T so as to keep constant the torque T obtained in the above-mentioned rotational angle region. More preferably, the first and second decreasing radius portions $Q_4Q_5$ and $Q_5Q_6$ have their cam profiles configurated in the form of quadratic curves to obtain constant contact pressure of the vane 3*b* against these portions.

Next, the third and fourth decreasing radius portions $Q_7Q_8$ and $Q_8Q_9$ have such cam profiles as gradually increase and gradually decrease the receding velocity of the vane 3*b*, respectively, and are arranged in a rotational angle region of the rotor corresponding to a latter half portion of the discharge stroke. These decreasing radius portions $Q_7Q_8$ and $Q_8Q_9$ serve to reduce the vane protruding amount H to zero at the end of the operating cycle in a prompt and smooth manner for smooth transition to the next operating cycle, the vane protruding amount H having so far maintained substantially constant by the terminating end portion of the second decreasing radius portion $Q_5Q_6$ or by the second constant radius portion $Q_6Q_7$ immediately following the portion $Q_5Q_6$. The decreasing radius portions $Q_7Q_8$ and $Q_8Q_9$ preferably have quadratically curved cam profiles for assuring constant pressure of the vane 3*b* against these portions.

The regularly circuit portion $Q_0Q_1$ serves to effect sealing between the rotor 3 and the camming inner peripheral surface 2*d*, but may be omitted if required.

The first constant radius portion $Q_3Q_4$ serves to increase the work to be done by the compressor in a former half portion of the compression stroke or in a middle portion of same, to thereby increase the compression pressure P for flattening the torque curve. However, also this portion may be omitted if necessary.

The second constant radius portion $Q_6Q_7$ also has a similar function to the first constant radius portion $Q_3Q_4$. That is, the second constant radius portion $Q_6Q_7$ is preferably arranged in a rotational angle region of the rotor corresponding to the discharge stroke where the fluid pressure P maintains a substantially constant value, and serves to keep the vane protruding amount H constant over a wide rotational angle region of the rotor to flatten the torque curve.

The vane protruding amount $H_2$ at the terminating end of the increasing radius portion $Q_1Q_3$ is set at a value equal to 0.1.Ro−0.5.Ro, where Ro represents the radius of the rotor. The vane protruding amount $H_4$ at the terminating end of the second decreasing radius portion $Q_5Q_6$ is set at a value equal to $0.3.H_2-0.7.H_2$. By setting the vane protruding amounts $H_2$ and $H_4$ at the above values, the camming inner peripheral surface 2*d* has a generally streamlined cam profile which can further effectively reduce the operating noise and vibrations of the compressor.

Description will now be made of the manner of calculating the cam profiles of the first and second increasing radius portions $Q_1Q_3$ and the first through fourth decreasing radius portions $Q_4Q_5$, $Q_5Q_6$, $Q_7Q_8$ and $Q_8Q_9$, which vary along quadratic curves, with reference to FIG. 5 and FIGS. 8 through 15:

(1) First Increasing Radius Portion $Q_1Q_2$:

As shown in FIG. 8, the vane protruding amount H should increase from 0 to $H_1$ at a rate corresponding to a quadratic curve as Q varies from $Q_1$ to $Q_2$ so that during this increasing stroke, the vane protruding velocity gradually increases. Provided that the angle through which the rotor rotates, starting from the stating end of the present portion $Q_1Q_2$ is $Q-Q_1$, the vane protruding amount H must satisfy an equation of $H=a(Q-Q_1)^2$, where a is a coefficient (>0), to realize the above requirement. Since the vane protruding amount H at the terminating end of the present portion $Q_1Q_2$ is $H_1$, and the total angle through which the rotor rotates from the starting end to the terminating end is $Q_2-Q_1$, the value of coefficient a is determined from an equation of $a=H_1/(Q_2-Q_1)^2$. Therefore, the vane protruding amount H and the distance E between the center O of the rotor and the camming inner peripheral surface 2*d*, applied to the present portion $Q_1Q_2$, are determined from the following equations:

$$H=a(Q-Q_1)^2=H_1/(Q_2-Q_1)^2\times(Q-Q_1)^2$$

$$R=Ro+H=Ro+H_1/(Q_2-Q_1)^2\times(Q-Q_1)^2$$

(2) Second Increasing Radius Portion $Q_2Q_3$:

As shown in FIG. 9, the vane protruding amount H should increase from $H_1$ to $H_2$ at a rate corresponding to a quadratic curve as Q varies from $Q_2$ to $Q_3$ so that during this increasing stroke, the vane protruding velocity gradually decreases. To realize this, the total change $H_2-H_1$ in the vane protruding amount H, obtained along the whole portion $Q_2Q_3$ must satisfy an equation of $-(H_2-H_1)=b(Q_3-Q_2)^2$, where b is a coefficient (<0). The value of coefficient b is therefore determined as $b=H_1-H_2/(Q_3-Q_2)^2$. The vane protruding amount H and the rotational angle Q must satisfy an equation of $-(H_2-H)=b(Q_3-Q)^2$. Therefore, the vane protruding amount H and the distance R between the center O of the rotor and the camming inner peripheral surface 2*d*, applied to the present portion $Q_2Q_3$ are determined from the following equation:

$$H=H_2+b(Q_3-Q)^2=H_2+(H_1-H_2)/(Q_3-Q_2)^2\times(Q_3-Q)^2$$

$$R=Ro+H-=Ro+H_2+(H_1-H_2)/(Q_3-Q_2)^2\times(Q_3-Q)^2$$

(3) First Decreasing Radius Portion $Q_4Q_5$:

As shown in FIG. 11, the vane protruding amount H should decrease from $H_2$ to $H_2-H_3$ at a rate corresponding to a quadratic curve as Q varies from $Q_4$ to $Q_5$ so that during this decreasing stroke, the vane receding velocity gradually increases. To achieve this, a relationship of $-H_3=c(Q_5-Q_4)^2$ must be satisfied, where c is a coefficient (<0). Therefore, the value of coefficient c is determined from an equation of $c=-H_3/(Q_5-Q_4)^2$. The vane protruding amount H and the rotational angle Q must satisfy an equation of $-(H_2-H)=c(Q-Q_4)^2$. Therefore, the vane protruding amount H and the distance R between the center O of the rotor and the camming inner peripheral surface 2*d*, applied to the present portion $Q_4Q_5$, are determined from the following equations:

$$H=H_2+c(Q-Q_4)^2=H_2-H_3/(Q_5-Q_4)^2\times(Q-Q_4)^2$$

$$R=Ro+H=Ro+H_2-H_3/(Q_5-Q_4)^2\times(Q-Q_4)^2$$

(4) Second Decreasing Radius Portion $Q_5Q_6$:

As shown in FIG. 12, the vane protruding amount H should decrease from $H_2-H_3$ to $H_4$ at a rate corresponding to a quadratic curve as Q varies from $Q_5$ to $Q_6$ so that during this decreasing stroke, the vane receding velocity gradually decreases. To achieve this, a relationship of $H_2-H_3-H_4=d(Q_6-Q_5)^2$ must be satisfied, where d is a coefficient (>0). The value of coefficient d is determined from an equation of $d=H_2-H_3-H_4/(Q_6-Q_5)^2$. At the present portion $Q_5Q_6$, the vane protruding amount H and the rotational angle Q must satisfy a relationship of $H-H_4=d(Q_6-Q)^2$. Therefore, the vane protruding amount H and the distance R between the center O of the rotor and the camming inner peripheral surface 2d, applied to this portion $Q_5Q_6$, are determined from the following equations:

$$H=H_4+d(Q_6-Q)^2=H_4+(H_2-H_3-H_4)/(Q_6-Q_5)^2\times(Q_6-Q)^2$$

$$R=Ro+H=Ro+H_4+(H_2-H_3-H_4)/(Q_6-Q_5)^2\times(Q_6-Q)^2$$

(5) Third Decreasing Radius Portion $Q_7Q_8$:

As shown in FIG. 14, the vane protruding amount H should decrease from $H_4$ to $H_4-H_5$ at a rate corresponding to a quadratic curve as Q varies from $Q_7$ to $Q_8$ so that during this decreasing stroke, the vane receding velocity gradually increases. To achieve this, a relationship of $H_5=e(Q_8-Q_7)^2$ must be satisfied, where e is a coefficient (>0). The value of coefficient e is determined from an equation of $e=H_5/(Q_8-Q_7)^2$. At this portion, the vane protruding amount H and the rotational angle Q must satisfy a relationship of $H_4-H=e(Q-Q_7)^2$. Therefore, the vane protruding amount H and the distance R between the center O of the rotor and the camming inner peripheral surface 2d are determined from the following equations:

$$H=H_4-e(Q-Q_7)^2=H_4-H_5/(Q_8-Q_7)^2\times(Q-Q_7)^2$$

$$R=Ro+H=Ro+H_4-H_5/(Q_8-Q_7)^2\times(Q-Q_7)^2$$

(6) Fourth Decreasing Radius Portion $Q_8Q_9$:

As shown in FIG. 15, the vane protruding amount H should decrease from $H_4-H_5$ to 0 at a rate corresponding to a quadratic curve as Q varies from $Q_8$ to $Q_9$ so that during this decreasing stroke, the vane receding velocity gradually decreases. To achieve this, a relationship of $H_4-H_5=f(Q_9-Q_8)^2$ must be fulfilled, where f is a coefficient (>0). The value of coefficient f is determined from an equation of $f=(H_4-H_5)/(Q_9-Q_8)^2$. At this portion $Q_8Q_9$, the vane protruding amount H and the distance R between the center O of the rotor and the camming inner peripheral surface 2d are determined from the following equations:

$$H=f(Q_9-Q)^2=(H_4-H_5)/(Q_9-Q_8)^2\times(Q_9-Q)^2$$

$$R=Ro+H=Ro+(H_4-H_5)/(Q_9-Q_8)^2\times(Q_9-Q)^2$$

FIGS. 10 and 13 show the relationships between the vane protruding amount H and the rotational angle Q, respectively, at the first constant radius portion $Q_3Q_4$ and the second constant radius portion $Q_6Q_7$. It will be learned from these figures that the vane protruding amount H assumes constant values $H_2$ and $H_4$ at these portions, irrespective of the rotational angle Q.

Figure 6:
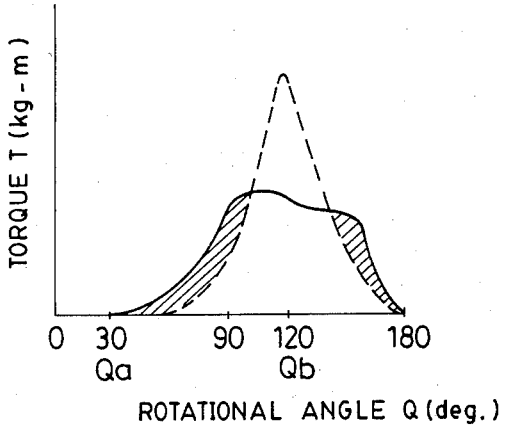
FIG. 6 is a graph showing T-Q curves representing the relationships between the torque T and the rotational angle Q, plotted as if obtained by a single vane moved along a conventional camming surface and along one according to the present invention.
Figure 7:
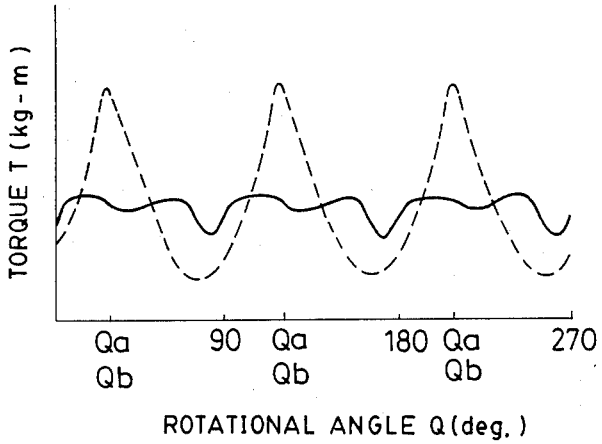
FIG. 7 is a graph showing T-Q curves representing the relationship between the torque T and the rotational angle Q, plotted as if obtained by all the four vanes moved along a conventional camming surface and along one according to the present invention.

FIGS. 6 and 7 show T-Q curves which are plotted as if obtained by a single vane and by four cooperative vanes in double pumping chamber type compressors, respectively. In the figures, conventional T-Q curves are indicated by the break lines, and T-Q curves according to the present invention by the solid lines, respectively. It will be noted from FIGS. 6 and 7 that according to the camming inner peripheral surface 2d having quadratic cam profiles of the present invention, the peak torque is lower by about 40 percent than that obtained by the conventional compressor. Further, according to the present invention, the work done by the compressor can be increased at the hatched portion in FIG. 6, achieving a flattened torque curve with no loss in the work done by the compressor, and thereby effectively reducing the operating noise and vibration of the compressor.

Although the foregoing embodiment is applied to a double pumping chamber type compressor, the present invention may be applied to various types of compressors having other numbers of pumping chambers, as well.

What is claimed is:

1. In a vane compressor including: a pump housing having inner surfaces thereof formed with an endless camming inner peripheral surface; a cylindrical rotor rotatably received within said pump housing, said rotor having an outer peripheral surface thereof formed therein with a plurality of axial slits; a plurality of vanes radially movably fitted in said slits of said rotor; and a drive shaft coupled to said rotor for causing rotation of said rotor in unison therewith; whereby rotation of said rotor causes said vanes to slidingly move along said endless camming inner peripheral surface of said pump housing n a predetermined circumferential direction to define at least one pumping chamber between the inner surfaces of said pump housing, the outer peripheral surface of said rotor and said vanes, for performing suction, compression and discharge of fluid, the improvement wherein said endless camming inner peripheral surface of said pump housing has at least one portion for performing one cycle comprising a suction stroke, a compression stroke and a discharge stroke of fluid in cooperation with said vanes and said rotor, which consists essentially of: an increasing radius portion having a cam profile such that each of said vanes has an amount of protrusion from said rotor gradually increasing with movement thereof along said increasing radius portion, said increasing radius portion consisting of a first portion having a cam profile such that said each vane has a protruding velocity thereof gradually increasing as it moves along said first portion, and a second portion having a cam profile such that said each vane has a protruding velocity thereof gradually decreasing as it moves along said second portion; a first decreasing radius portion having a cam profile such that said each vane has an amount of protrusion thereof from said rotor gradually decreasing and a receding velocity thereof gradually increasing, as it moves along said first decreasing radius portion; a second decreasing radius portion having a cam profile such that said each vane has an amount of protrusion from said rotor gradually decreasing and a receding velocity thereof gradually decreasing, as it moves along said second decreasing radius portion; a third decreasing radius portion having a cam profile such that said each vane has an amount of protrusion from said rotor gradually decreasing and a receding velocity thereof gradually increasing as it moves along said third decreasing radius portion; and a fourth decreasing radius portion having a cam profile such that said each vane has an amount of protrusion from said rotor gradually decreasing and a receding velocity thereof gradually decreasing as it moves along said fourth decreasing radius portion; said first and second portions of said increasing radius portion and said first, second, third and fourth decreasing radius portions each having a starting end and a terminating end, and being successively arranged in the order mentioned in said predetermined moving direction of said vanes, said first and second portions of said increasing radius portions having their combined circumferential angle set at a value smaller than 90°, said first and second decreasing radius portions being at least in part located in a rotational angle region of said rotor where fluid pressure acting upon a portion of said each vane protruded from said rotor rapidly increases with movement of said each vane along the same region, whereby fluctuations in torque acting upon said rotor are restrained in said rotational angle region of said rotor.

2. The vane compressor as claimed in claim 1, wherein at least one of said first and second portions of said increasing radius portion and said first, second, third and fourth decreasing radius portions has a cam profile such that the distance between the center of said rotor and the camming inner peripheral surface of said at least one portion varies along a quadratic curve.

3. The vane compressor as claimed in claim 2, wherein said first portion of said increasing radius portion has a cam profile obtained by the following equation:

$$R = Ro + (\theta a/\phi a)^2 Ha$$

where

R = the distance between the center of the rotor and the camming inner peripheral surface of the first portion of the increasing radius portion, Ro = the radius of the rotor, $\theta a$ = the angle at which tip of each vane moving from the starting end of the first portion of the increasing radius portion toward the terminating end thereof lies apart from the starting end of the same first portion with respect to the center of the rotor, $\theta a$ = the angle through which the first portion of the increasing radius portion circumferentially extends with respect to the center of the rotor, and Ha = the amount of protrusion of each vane from the rotor at the terminating end of the first portion of the increasing radius portion.

4. The vane compressor as claimed in claim 2, wherein said second portion of said increasing radius portion has a cam profile obtained by the following equation and inequality:

$$R = Ro + Hb + (\theta b/\phi b)^2 (Ha - Hb), \text{ and } Ha < Hb$$

where

R = the distance between the center of the rotor and the camming inner peripheral surface of the second portion of the increasing radius portion, Ro = the radius of the rotor, Ha = the amount of protrusion of each vane from the rotor at the terminating end of the first portion of the increasing radius portion, Hb = the amount of protrusion of each vane from the rotor at the terminating end of the second portion of the increasing radius portion, $\theta b$ = the angle at which tip of each vane moving from the starting end of the second portion of the increasing radius portion toward the terminating end thereof lies apart from the starting end of the same second portion with respect to the center of the rotor, and $\phi b$ = the angle through which the second portion of the increasing radius portion circumferentially extends with respect to the center of the rotor.

5. The vane compressor as claimed in claim 2, wherein said first decreasing radius portion has a cam profile obtained by the following equation and inequality:

$$R = Ro + Hb - (\theta c/\phi c)^2 Hc, \text{ and } Hb > Hc$$

where

R = the distance between the center of the rotor and the camming inner peripheral surface of the first decreasing radius portion, Ro = the center of the rotor, Hb = the amount of protrusion of each vane from the rotor at the terminating end of the second portion of the increasing radius portion, Hc = the amount by which each vane recedes into the rotor as it moves from the starting end of the first decreasing portion to the terminating end thereof, $\theta c$ = the angle at which tip of each vane moving from the starting end of the first decreasing radius portion toward the terminating end thereof lies apart from the starting end of the same portion with respect to the center of the rotor, and $\phi c$ = the angle through which the first decreasing radius portion circumferentially extends with respect to the center of the rotor.

6. The vane compressor as claimed in claim 2, wherein said second decreasing radius portion has a cam profile obtained by the following equation and inequalities:

$$R = Ro + Hd + (\theta d/\phi d)^2 (Hb - Hc - Hd), \; Hb > Hc, \text{ and } Hb > Hd$$

where R = the distance between the center of the rotor and the camming inner peripheral surface of the second decreasing radius portion, Ro = the radius of the rotor, Hb = the amount of protrusion of each vane from the rotor at the terminating end of the second increasing radius portion, Hc = the amount of protrusion of each vane from the rotor at the terminating end of the second decreasing radius portion, Hd = the amount of protrusion of each vane from the rotor at the terminating end of the second decreasing radius portion, $\theta d$ = the angle at which tip of each vane moving from the starting end of the second decreasing radius portion toward the terminating end thereof lies apart from the starting end of the same portion with respect to the center of the rotor, and $\phi d$ = the angle through which the second decreasing radius portion circumferentially extends with respect to the center of the rotor.

7. The vane compressor as claimed in claim 2, wherein said third decreasing radius portion has a cam profile obtained by the following equation:

$$R = Ro + Hd + (\theta e/\phi e)^2 He$$

where

R = the distance between the center of the rotor and the camming inner peripheral surface of the third decreasing radius portion, Ro = the radius of the rotor, Hd = the amount of protrusion of each vane from the rotor at the terminating end of the second decreasing radius portion, He = the amount by which each vane recedes into the rotor as it moves from the starting end of the third decreasing radius portion to the terminating end thereof, $\theta e$ = the angle at which tip of each vane moving from the starting end of the third decreasing radius portion toward the terminating end thereof lies apart from the starting end of the same portion with respect to the center of the rotor, and $\phi e$ = the angle through which the third decreasing radius portion circumferentially extends with respect to the center of the rotor.

8. The vane compressor as claimed in claim 2, wherein said fourth decreasing radius portion has a cam profile obtained by the following equation and inequality:

$$R = Ro + (\theta f/\phi f)^2 (Hd - He), \text{ and } Hd > He$$

where R = the distance between the center of the rotor and the camming inner peripheral surface of the fourth decreasing radius portion, Ro = the radius of the rotor, Hd = the amount of protrusion of each vane from the rotor at the terminating end of the second decreasing radius portion, He = the amount by which each vane recedes into the rotor as it moves from the starting end of the third decreasing radius portion to the terminating end therof, Hd-He = the amount by which each vane recedes into the rotor as it moves from the starting end of the fourth decreasing radius portion to the temrinating end thereof, $\theta f$ = the angle at which tip of each vane moving from the starting end of the fourth decreasing radius portion toward the terminating end thereof lies apart from the starting end of the same portion with respect to the center of the rotor, and $\phi f$ = the angle through which the fourth decreasing radius portion circumferentially extends with respect to the center of the rotor.

9. The vane compressor as claimed in any one of claims 1 and 2, wherein said one cycle performing portion of said endless camming inner peripheral surface further includes a constant radius portion located between said increasing radius portion and said first decreasing radius portion, and along which the amount of protrusion of each vane from the rotor is kept substantially constant with movement of the vane, said constant radius portion having a starting end and a terminating end between which the same portion has a camming inner peripheral surface thereof kept at a distance from the center of the rotor, which is obtained by the following equation:

$$R = Ro + Hb$$

where R = the distance between the center of the rotor and the camming inner peripheral surface of the constant radius portion, Ro = the radius of the rotor, and Hb = the amount of protrusion of each vane from the rotor at the terminating end of the increasing radius portion.

10. The vane compressor as claimed in any one of claims 1 and 2, wherein said one cycle performing portion of said endless camming inner peripheral surface further includes a constant radius portion located between said second decreasing radius portion and said third decreasing radius portion, and along which the amount of protrusion of each vane from the rotor is kept substantially constant with movement of the vane, said constant radius portion having a starting end and a terminating end between which the same portion has a camming inner peripheral surface thereof kept at a distance from the center of the rotor, which is obtained by the following equation:

$$R = Ro + Hd$$

where R = the distance between the center of the rotor and the camming inner peripheral surface of the constant radius portion, Ro = the radius of the rotor, and Hd = the amount of protrusion of each vane from the rotor at the terminating end of the second decreasing radius portion.

11. The vane compressor as claimed in any one of claims 1 and 2, wherein said one cycle performing portion of said endless camming inner peripheral surface further includes a constant radius portion located at one of a location immediately preceding said increasing radius portion and a location immediately following said fourth decreasing radius portion in said predetermined moving direction of said vanes, along which sealing is effected between said rotor and said pump housing, said constant radius portion having a starting end and a terminating end between which the same portion has a camming inner peripheral surface thereof kept at a distance from the center of the rotor, which is obtained by the following equation:

$$R = Ro$$

where R = the distance between the center of the rotor and the camming inner peripheral surface of the constant radius portion, and Ro = the radius of the rotor.

12. The vane compressor as claimed in any one of caims 1 and 2, wherein said one cycle performing portion of said endless camming inner peripheral surface further includes: a first constant radius portion located between said increasing radius portion and said first decreasing radius portion, and along which the amount of protrusion of each vane from the rotor is kept substantially constant with movement of the rotor; a second constant radius portion located between said second decreasing radius portion and said third decreasing radius portion, and along which the amount of protrusion of each vane from the rotor is kept substantially constant with movement of the vane; and a third constant radius portion located at one of a location immediately preceding said increasing radius portion and a location immediately following said fourth decreasing radius portion in said predetermined moving direction of said vanes, and along which sealing is effected between said rotor and said pump housing; said first, second and third constant radius portions each having a starting end and a terminating end between which the same portion has a camming inner peripheral surface thereof kept at a distance from the center of the rotor, which is obtained by the following equation:

$$R_1 = Ro + Hb \quad (1)$$

$$R_2 = Ro + Hd \quad (2)$$

$$R_3 = Ro \quad (3)$$

where $R_1$ = the distance between the center of the rotor and the camming inner peripheral surface of the first constant radius portion, $R_2$ = the distance between the center of the rotor and the camming inner peripheral surface of the second constant radius portion, $R_3$ = the distance between the center of the rotor and the camming inner peripheral surface of the third constant radius portion, Ro = the radius of the rotor, Hb = the amount of protrusion of each vane from the rotor at the terminating end of the increasing radius portion, and Hd = the amount of protrusion of each vane from the rotor at the terminating end of the second decreasing radius portion.

13. The vane compressor as claimed in claim 1, wherein all of said first and second portions of said increasing radius portion and said first, second, third and fourth decreasing radius portions have cam profiles such that the distance between the center of said rotor and the camming inner peripheral surface of each of said portion varies along a quadratic curve.

14. The vane compressor as claimed in claim 1, wherein said first and second portions of said increasing radius portion being located so as to perform the whole of said suction stroke and a former half portion of said compression stroke, said first decreasing radius portion being located so as to perform a latter half portion of said compression stroke, said second decreasing radius portion being located so as to perform the latter half portion of said compression stroke and a former half portion of said discharge stroke, said third and fourth decreasing radius portions being located so as to perform a latter half portion of the discharge stoke.

15. The vane compressor as claimed in claim 1, wherein each of said second and fourth decreasing radius portions has such a cam profile as to reduce said receding velocity of each of said vanes to zero.

16. In a vane compressor including: a pump housing having inner surfaces thereof formed with an endless camming inner peripheral surface; a cylindrical rotor rotatably received within said pump housing, said rotor having an outer peripheral surface thereof formed therein with a plurality of axial slits; a plurality of vanes radially movably fitted in said slits of said rotor; and a drive shaft coupled to said rotor for causing rotation of said rotor in unison therewith; whereby rotation of said rotor causes said vanes to slidingly move along said endless camming inner peripheral surface of said pump housing in a predetermined circumferential direction to define at least one pumping chamber between the inner surfaces of said pump housing, the outer compression and discharge of fluid, the improvement wherein said endless camming inner peripheral surface of said pump housing has at least one portion for performing one cycle of suction, compression and discharge of fluid in cooperation with said vanes and said rotor, which portion comprises: an increasing radius portion having a cam profile such that each of said vanes has an amount of protrusion from said rotor gradually increasing with movement thereof along said increasing radius portion; a first decreasing radius portion having a cam profile such that said each vane has an amount of protrusion thereof from said rotor gradually decreasing and a receding velocity thereof gradually increasing, as it moves along said first decreasing radius portion; a second decreasing radius portion having a cam profile such that said each vane has an amount of protrusion from said rotor gradually decreasing and a receding velocity thereof gradually decreasing, as it moves along said second decreasing radius portion; a third decreasing radius portion having a cam profile such that said each vane has an amount of protrusion from said rotor gradually decreasing and a receding velocity thereof gradually increasing as it moves along said third decreasing radius portion; and a fourth decreasing radius portion having a cam profile such that said each vane has an amount of protrusion from said rotor gradually decreasing and a receding velocity thereof gradually decreasing as it moves along said fourth decreasing radius portion; said increasing radius portion, and said first, second, third and fourth decreasing radius portions each having a starting end and a terminating end, and being successively arranged in the order mentioned in said predetermined moving direction of said vanes, said first and second decreasing radius portions being at least in part located in a rotational angle region of said rotor where fluid pressure acting upon a portion of said each vane protruded from said rotor rapidly increases with movement of said each vane along the same region, whereby fluctuations in torque acting upon said rotor are restrained in said rotational angle region of said rotor; said increasing radius portion comprising a first portion having a cam profile such that said each vane has a protruding velocity thereof gradually increasing as it moves along said first portion, and a second portion having a cam profile such that said each vane has a protruding velocity thereof gradually decreasing as it moves along said second portion; at least one of said first and second portions of said increasing radius portion and said first, second, third and fourth decreasing radius portions having a cam profile such that the distance between the center of said rotor and the camming inner peripheral surface of said at least one portion varies along a quadratic curve; said first portion of said increasing radius portion having a cam profile obtained by the following equations:

$$R=Ro+(\theta a/\phi a)^2\ Ha$$

where R = the distance between the center of the rotor and the camming inner peripheral surface of the first portion of the increasing radius portion, Ro = the radius of the rotor, $\theta$a = the angle at which tip of each vane moving from the starting end of the first portion of the increasing radius portion toward the terminating end thereof lies apart from the starting end of the same first portion with respect to the center of the rotor, $\phi$a = the angle through which the first portion of the increasing radius portion circumferentially extends with respect to the center of the rotor, and Ha = the amount of protrusion of each vane from the rotor at the terminating end of the first portion of the increasing radius portion.

17. In a vane compressor including: a pump housing having inner surfaces thereof formed with an endless camming inner peripheral surface; a cylindrical rotor rotatably received within said pump housing, said rotor having an outer peripheral surface thereof formed therein with a plurality of axial slits; a plurality of vanes radially movably fitted in said slits of said rotor; and a drive shaft coupled to said rotor for causing rotation of said rotor in unison therewith; whereby rotation of said rotor causes said vanes to slidingly move along said endless camming inner peripheral surface of said pump housing in a predetermined circumferential direction to define at least one pumping chamber between the inner surfaces of said pump housing, the outer compression and discharge of fluid, the improvement wherein said endless camming inner peripheral surface of said pump housing has at least one portion for performing one cycle of suction, compression and discharge of fluid in cooperation with said vanes and said rotor, which portion comprises: an increasing radius portion having a cam profile such that each of said vanes has an amount of protrusion from said rotor gradually increasing with movement thereof along said increasing radius portion; a first decreasing radius portion having a cam profile such that said each vane has an amount of protrusion thereof from said rotor gradually decreasing and a receding velocity thereof gradually increasing, as it moves along said first decreasing radius portion; a second decreasing radius portion having a cam profile such that said each vane has an amount of protrusion from said rotor gradually decreasing and a receding velocity thereof gradually decreasing, as it moves along said second decreasing radius portion; a third decreasing radius portion having a cam profile such that said each vane has an amount of protrusion from said rotor gradually decreasing and a receding velocity thereof gradually increasing as it moves along said third decreasing radius portion; and a fourth decreasing radius portion having a cam profile such that said each vane has an amount of protrusion from said rotor gradually decreasing and a receding velocity thereof gradually decreasing as it moves along said fourth decreasing radius portion; said increasing radius portion, and said first, second, third and fourth decreasing radius portions each having a starting end and a terminating end, and being successively arranged in the order mentioned in said predetermined moving direction of said vanes, said first and second decreasing radius portions being at least in part located in a rotational angle region of said rotor where fluid pressure acting upon a portion of said each vane protruded from said rotor rapidly increases with movement of said each vane along the same region, whereby fluctuations in torque acting upon said rotor are restrained in said rotational angle region of said rotor; said increasing radius portion comprising a first portion having a cam profile such that said each vane has a protruding velocity thereof gradually increasing as it moves along said first portion, and a second portion having a cam profile such that said each vane has a protruding velocity thereof gradually decreasing as it moves along said second portion; at least one of said first and second portions of said increasing radius portion and said first, second, third and fourth decreasing radius portions having a cam profile such that the distance between the center of said rotor and the camming inner peripheral surface of said at least one portion varies along a quadratic curve; said second portion of said increasing radius porting having a cam profile obtained by the following equation and inequality:

$$R=Ro+Hb+(\theta b/\phi b)^2(Ha-Hb),\ \text{and}\ Ha<Hb$$

where R = the distance between the center of the rotor and the camming inner peripheral surface of the second portion of the increasing radius portion, Ro = the radius of the rotor, Ha = the amount of protrusion of each vane from the rotor at the terminating end of the first portion of the increasing radius portion, Hb = the amount of protrusion of each vane from the rotor at the terminating end of the second portion of the increasing radius portion, $\theta$b = the angle at which tip of each vane moving from the starting end of the second portion of the increasing radius portion toward the terminating end thereof lies apart from the starting end of the same second portion with respect to the center of the motor, and $\phi$b = the angle through which the second portion of the increasing radius portion circumferentially extends with respect to the center of the rotor.

18. In a vane compressor including: a pump housing having inner surfaces thereof formed with an endless camming inner peripheral surface; a cylindrical rotor rotatably received within said pump housing, said rotor having an outer peripheral surface thereof formed therein with a plurality of axial slits; a plurality of vanes radially movably fitted in said slits of said rotor; and a drive shaft coupled to said rotor for causing rotation of said rotor in unison therewith; whereby rotation of said rotor causes said vanes to slidingly move along said endless camming inner peripheral surface of said pump housing in a predetermined circumferential direction to define at least one pumping chamber between the inner surfaces of said pump housing, the outer compression and discharge of fluid, the improvement wherein said endless camming inner peripheral surface of said pump housing has at least one portion for performing one cycle of suction, compression and discharge of fluid in cooperation with said vanes and said rotor, which portion comprises: an increasing radius portion having a cam profile such that each of said vanes has an amount of protrusion from said rotor gradually increasing with movement thereof along said increasing radius portion; a first decreasing radius portion having a cam profile such that said each vane has an amount of protrusion thereof from said rotor gradually decreasing and a receding velocity thereof gradually increasing, as it moves along said first decreasing radius portion; a second decreasing radius portion having a cam profile such that said each vane has an amount of protrusion from said rotor gradually decreasing and a receding velocity thereof gradually decreasing, as it moves along said second decreasing radius portion; a third decreasing radius portion having a cam profile such that said each vane has an amount of protrusion from said rotor gradually decreasing and a receding velocity thereof gradually increasing as it moves along said third decreasing radius portion; and a fourth decreasing radius portion having a cam profile such that said each vane has an amount of protrusion from said rotor gradually decreasing and a receding velocity thereof gradually decreasing as it moves along said fourth decreasing radius portion; said increasing radius portion, and said first, second, third and fourth decreasing radius portions each having a starting end and a terminating end, and being successively arranged in the order mentioned in said predetermined moving direction of said vanes, said first and second decreasing radius portions being at least in part located in a rotational angle region of said rotor where fluid pressure acting upon a portion of said each vane protruded from said rotor rapidly increases with movement of said each vane along the same region, whereby fluctuations in torque acting upon said rotor are restrained in said rotational angle region of said rotor; said increasing radius portion comprising a first portion having a cam profile such that said each vane has a protruding velocity thereof gradually increasing as it moves along said first portion, and a second portion having a cam profile such that said each vane has a protruding velocity thereof gradually decreasing as it moves along said second portion; at least one of said first and second portions of said increasing radius portion and said first, second, third and fourth decreasing radius portions having a cam profile such that the distance between the center of said rotor and the camming inner peripheral surface of said at least one portion varies along a quadratic curve; said first decreasing radius portion having a cam profile obtained by the following equation and inequality:

$$R=Ro+Hb-(\theta c/\phi c)^2Hc, \text{ and } Hb>Hc$$

where R = the distance between the center of the rotor and the camming inner peripheral surface of the first decreasing radius portion, Ro = the center of the rotor, Hb = the amount of protrusion of each vane from the rotor at the terminating end of the second portion of the increasing radius portion, Hc = the amount by which each vane recedes into the rotor as it moves from the starting end of the first decreasing portion to the terminating end thereof, $\theta c$ = the angle at which tip of each vane moving from the starting end of the first decreasing radius portion toward the terminating end thereof lies apart from the starting end of the same portion with respect to the center of the rotor, and $\phi c$ = the angle through which the first decreasing radius portion circumferentially extends with respect to the center of the rotor.

19. In a vane compressor including: a pump housing having inner surfaces thereof formed with an endless camming inner peripheral surface; a cylindrical rotor rotatably received within said pump housing, said rotor having an outer peripheral surface thereof formed therein with a plurality of axial slits; a plurality of vanes radially movably fitted in said slits of said rotor; and a drive shaft coupled to said rotor for causing rotation of said rotor in unison therewith; whereby rotation of said rotor causes said vanes to slidingly move along said endless camming inner peripheral surface of said pump housing in a predetermined circumferential direction to define at least one pumping chamber between the inner surfaces of said pump housing, the outer compression and discharge of fluid, the improvement wherein said endless camming inner peripheral surface of said pump housing has at least one portion for performing one cycle of suction, compression and discharge of fluid in cooperation with said vanes and said rotor, which portion comprises: an increasing radius portion having a cam profile such that each of said vanes has an amount of protrusion from said rotor gradually increasing with movement thereof along said increasing radius portion; a first decreasing radius portion having a cam profile such that said each vane has an amount of protrusion thereof from said rotor gradually decreasing and a receding velocity thereof gradually increasing, as it moves along said first decreasing radius portion; a second decreasing radius portion having a cam profile such that said each vane has an amount of protrusion from said rotor gradually decreasing and a receding velocity thereof gradually decreasing, as it moves along said second decreasing radius portion; a third decreasing radius portion having a cam profile such that said each vane has an amount of protrusion from said rotor gradually decreasing and a receding velocity thereof gradually increasing as it moves along said third decreasing radius portion; and a fourth decreasing radius portion having a cam profile such that said each vane has an amount of protrusion from said rotor gradually decreasing and a receding velocity thereof gradually decreasing as it moves along said fourth decreasing radius portion; said increasing radius portion, and said first, second, third and fourth decreasing radius portions each having a starting end and a terminating end, and being successively arranged in the order mentioned in said predetermined moving direction of said vanes, said first and second decreasing radius portions being at least in part located in a rotational angle region of said rotor where fluid pressure acting upon a portion of said each vane protruded from said rotor rapidly increases with movement of said each vane along the same region, whereby fluctuations in torque acting upon said rotor are restrained in said rotational angle region of said rotor; said increasing radius portion comprising a first portion having a cam profile such that said each vane has a protruding velocity thereof gradually increasing as it moves along said first portion, and a second portion having a cam profile such that said each vane has a protruding velocity thereof gradually decreasing as it moves along said second portion; at least one of said first and second portions of said increasing radius portion and said first, second, third and fourth decreasing radius portions having a cam profile such that the distance between the center of said rotor and the camming inner peripheral surface of said at least one portion, varies along a quadratic curve; said second decreasing radius portion having a cam profile obtained by the following equation and inequalities:

$$R=Ro+Hd+(\theta d/\phi d)^2(Hb-Hc-Hd),\ Hb>Hc, \text{ and } Hb>Hd$$

where R = the distance between the center of the rotor and the camming inner peripheral surface of the second decreasing radius portion, Ro = the radius of the rotor, Hb = the amount of protrusion of each vane from the rotor at the terminating end of the second increasing radius portion, Hc = the amount of protrusion of each vane from the rotor at the terminating end of the second decreasing radius portion, Hd = the amount of protrusion of each vane from the rotor at the terminating end of the second decreasing radius portion, $\theta d$ = the angle at which tip of each vane moving from the starting end of the second decreasing radius portion toward the terminating end thereof lies apart from the starting end of the same portion with respect to the center of the rotor, and $\phi d$ = the angle through which the second decreasing radius portion circumferentially extends with respect to the center of the rotor.

20. In a vane compressor including: a pump housing having inner surfaces thereof formed with an endless camming inner peripheral surface; a cylindrical rotor rotatably received within said pump housing, said rotor having an outer peripheral surface thereof formed therein with a plurality of axial slits; a plurality of vanes radially movably fitted in said slits of said rotor; and a drive shaft coupled to said rotor for causing rotation of said rotor in unison therewith; whereby rotation of said rotor causes said vanes to slidingly move along said endless camming inner peripheral surface of said pump housing in a predetermined circumferential direction to define at least one pumping chamber between the inner surfaces of said pump housing, the outer compression and discharge of fluid, the improvement wherein said endless camming inner peripheral surface of said pump housing has at least one portion for performing one cycle of suction, compression and discharge of fluid in cooperation with said vanes and said rotor, which portion comprises: an increasing radius portion having a cam profile such that each of said vanes has an amount of protrusion from said rotor gradually increasing with movement thereof along said increasing radius portion; a first decreasing radius portion having a cam profile such that said each vane has an amount of protrusion thereof from said rotor gradually decreasing and a receding velocity thereof gradually increasing, as it moves along said first decreasing radius portion; a second decreasing radius portion having a cam profile such that said each vane has an amount of protrusion from said rotor gradually decreasing and a receding velocity thereof gradually decreasing, as it moves along said second decreasing radius portion; a third decreasing radius portion having a cam profile such that said each vane has an amount of protrusion from said rotor gradually decreasing and a receding velocity thereof gradually increasing as it moves along said third decreasing radius portion; and a fourth decreasing radius portion having a cam profile such that said each vane has an amount of protrusion from said rotor gradually decreasing and a receding velocity thereof gradually decreasing as it moves along said fourth decreasing radius portion; said increasing radius portion, and said first, second, third and fourth decreasing radius portions each having a starting end and a terminating end, and being successively arranged in the order mentioned in said predetermined moving direction of said vanes, said first and second decreasing radius portions being at least in part located in a rotational angle region of said rotor where fluid pressure acting upon a portion of said each vane protruded from said rotor rapidly increases with movement of said each vane along the same region, whereby fluctuations in torque acting upon said rotor are restrained in said rotational angle region of said rotor; said increasing radius portion comprising a first portion having a cam profile such that said each vane has a protruding velocity thereof gradually increasing as it moves along said first portion, and a second portion having a cam profile such that said each vane has a protruding velocity thereof gradually decreasing as it moves along said second portion; at least one of said first and second portions of said increasing radius portion and said first, second, third and fourth decreasing radius portions having a cam profile such that the distance between the center of said rotor and the camming inner pheripheral surface of said at least one portion varies along a quadratic curve; said third decreasing radius portion having a cam profile obtained by the following equation:

$$R = Ro + Hd + (\theta e/\phi e)^2 He$$

where R = the distance between the center of the rotor and the camming inner peripheral surface of the third decreasing radius portion, Ro = the radius of the rotor, Hd = the amount of protrusion of each vane from the rotor at the terminating end of the second decreasing radius portion, He = the amount by which each vane recedes into the rotor as it moves from the starting end of the third decreasing radius portion to the terminating end thereof, $\theta e$ = the angle at which tip of each vane moving from the starting end of the third decreasing radius portion toward the terminating end thereof lies apart from the starting end of the same portion with respect to the center of the rotor, and $\theta e$ = the angle through which the third decreasing radius portion circumferentially extends with respect to the center of the rotor.

21. In a vane compressor including: a pump housing having inner surfaces thereof formed with an endless camming inner peripheral surface; a cylindrical rotor rotatably received within said pump housing, said rotor having an outer peripheral surface thereof formed therein with a plurality of axial slits; a plurality of vanes radially movably fitted in said slits of said rotor; and a drive shaft coupled to said rotor for causing rotation of said rotor in unison therewith; whereby rotation of said rotor causes said vanes to slidingly move along said endless camming inner peripheral surface of said pump housing in a predetermined circumferential direction to define at least one pumping chamber between the inner surfaces of said pump housing, the outer compression and discharge of fluid, the improvement wherein said endless camming inner peripheral surface of said pump housing has at least one portion for performing one cycle of suction, compression and discharge of fluid in cooperation with said vanes and said rotor, which portion comprises: an increasing radius portion having a cam profile such that each of said vanes has an amount of protrusion from said rotor gradually increasing with movement thereof along said increasing radius portion; a first decreasing radius portion having a cam profile such that said each vane has an amount of protrusion thereof from said rotor gradually decreasing and a receding velocity thereof gradually increasing, as it moves along said first decreasing radius portion; a second decreasing radius portion having a cam profile such that said each vane has an amount of protrusion from said rotor gradually decreasing and a receding velocity thereof gradually decreasing, as it moves along said second decreasing radius portion; a third decreasing radius portion having a cam profile such that said each vane has an amount of protrusion from said rotor gradually decreasing and a receding velocity thereof gradually increasing as it moves along said third decreasing radius portion; and a fourth decreasing radius portion having a cam profile such that said each vane has an amount of protrusion from said rotor gradually decreasing and a receding velocity thereof gradually decreasing as it moves along said fourth decreasing radius portion; said increasing radius portion, and said first, second, third and fourth decreasing radius portions each having a starting end and a terminating end, and being successively arranged in the order mentioned in said predetermined moving direction of said vanes, said first and second decreasing radius portions being at least in part located in a rotational angle region of said rotor where fluid pressure acting upon a portion of said each vane protruded from said rotor rapidly increases with movement of said each vane along the same region, whereby fluctuations in torque acting upon said rotor are restrained in said rotational angle region of said rotor; said increasing radius portion comprising a first portion having a cam profile such that said each vane has a protruding velocity thereof gradually increasing as it moves along said first portion, and a second portion having a cam profile such that said each vane has a protruding velocity thereof gradually decreasing as it moves along said second portion; at least one of said first and second portions of said increasing radius portion and said first, second, third and fourth decreasing radius portions having a cam profile such that the distance between the center of said rotor and the camming inner peripheral surface of said at least one portion varies along a quadratic curve; said fourth decreasing radius portin has a cam profile obtained by the following equation and inequality:

$$R=Ro+(\theta f/\phi f)^2(Hd-He), \text{ and } Hd>He$$

where R=the distance between the center of the rotor and the camming inner peripheral surface of the fourth decreasing radius portion, Ro=the radius of the rotor, Hd=the amount of protrusion of each vane from the rotor at the terminating end of the second decreasing radius portion, He=the amount by which each vane recedes into the rotor as it moves from the starting end of the third decreasing radius portion to the terminating end thereof, Hd-He=the amount by which each vane recedes into the rotor as it moves from the starting end of the fourth decreasing radius portion to the terminating end thereof, $\theta f$=the angle at which tip of each vane moving from the starting end of the fourth decreasing radius portion toward the terminating end thereof lies apart from the starting end of the same portion with respect to the center of the rotor, and $\phi f$=the angle through which the fourth decreasing radius portion circumferentially extends with respect to the center of the rotor.

22. The vane compressor as claimed in any one of claims 16–21, wherein said one cycle performing portion of said endless camming inner peripheral surface further includes a constant radius portion located between said increasing radius portion and said first decreasing radius portion, and along which the amount of protrusion of each vane from the rotor is kept substantially constant with movement of the vane, said constant radius portion having a starting end and a terminating end between which the same portion has a camming inner peripheral surface thereof kept at a distance from the center of the rotor, which is obtained by the following equation:

$$R=Ro+Hb$$

where R=the distance between the center of the rotor and the camming inner peripheral surface of the constant radius portion, Ro=the radius of the rotor, and Hb=the amount of protrusion of each vane from the rotor at the terminating end of the increasing radius portion.

23. The vane compressor as claimed in any one of claims 16–21 wherein said one cycle performing portion of said endless camming inner peripheral surface further includes a constant radius portion located between said second decreasing radius portion and said third decreasing radius portion, and along which the amount of protrusion of each vane from the rotor is kept substantially constant with movement of the vane, said constant radius portion having a starting end and a terminating end between which the same portion has a camming inner peripheral surface thereof kept at a distance from the center of the rotor, which is obtained by the following equation:

$$R=Ro+Hd$$

where R=the distance between the center of the rotor and the camming inner peripheral surface of the constant radius portion, Ro=the radius of the rotor, and Hd=the amount of protrusion of each vane from the rotor at a terminating end of the second decreasing radius portion.

24. The vane compressor as claimed in any one of claims 16–21, wherein said one cycle performing protion of said endless camming inner peripheral surface further includes a constant radius portion located at one of a location immediately preceding said increasing radius portion and a location immediately following said fourth decreasing radius portion in said predetermined moving direction of said vanes, along which sealing is effected between said rotor and said pump housing, said constant radius portion having a starting end and a terminating end between which the same portion has a camming inner peripheral surface thereof kept at a distance from the center of the rotor, which is obtained by the following equation:

$$R=Ro$$

where R = the distance between the center of the rotor and the camming inner peripheral surface of the constant radius portion, and Ro = the radius of the rotor.

25. The vane compressor as claimed in any one of claims 16–21, wherein said one cycle performing portion of said endless camming inner peripheral surface further includes: a first constant radius portion located between said increasing radius portion and said first decreasing radius portion, and long which the amount of protrusion of each vane from the rotor is kept substantially constant with movement of the rotor; a second constant radius portion located between said second decreasing radius portion and said third decreasing radius portion, and along which the amount of protrusion of each vane from the rotor is kept substantially constant with movement of the vane; and a third constant radius portion located at one of a location immediately preceding said increasing radius portion and a location immediately following said fourth decreasing radius portion in said predetermined moving direction of said vanes, and along which sealing is effected between said rotor and said pump housing; said first, second and third constant radius portions each having a starting end and a terminating end between which the same portion has a camming inner peripheral surface thereof kept at a distance from the center of the rotor, which is obtained by the following equation:

$$R_1 = Ro + Hb \quad (1)$$

$$R_2 = Ro + Hd \quad (2)$$

$$R_3 = Ro \quad (3)$$

where $R_1$ = the distance between the center of the rotor and the camming inner peripheral surface of the first constant radius portion, $R_2$ = the distance between the center of the rotor and the camming inner peripheral surface of the second constant radius portion, $R_3$ = the distance between the center of the rotor and the camming inner peripheral surface of the third constant radius portion, Ro = the radius of the rotor, Hb = the amount of protrusion of each vane from the rotor at the terminating end of the increasing radius portion, and Hd = the amount of protrusion of each vane from the rotor at the terminating end of the second decreasing radius portion.

26. In a vane compressor including: a pump housing having inner surfaces thereof formed with an endless camming inner peripheral surface; a cylindrical rotor rotatably received within said pump housing, said rotor having an outer peripheral surface thereof formed therein with a plurality of axial slits; a plurality of vanes radially movably fitted in said slits of said rotor; and a drive shaft coupled to said rotor for causing rotation of said rotor in unison therewith; whereby rotation of said rotor causes said vanes to slidingly move along said endless camming inner peripheral surface of said pump housing in a predetermined circumferential direction to define at least one pumping chamber between the inner surfaces of said pump housing, the outer compression and discharge of fluid, the improvement wherein said endless camming inner peripheral surface of said pump housing has at least one portion for performing one cycle of suction, compression and discharge of fluid in cooperation with said vanes and said rotor, which portion comprises: an increasing radius portion having a cam profile such that each of said vanes has an amount of protrusion from said rotor gradually increasing with movement thereof along said increasing radius portion; a first decreasing radius portion having a cam profile such that said each vane has an amount of protrusion thereof from said rotor gradually decreasing and a receding velocity thereof gradually increasing, as it moves along said first decreasing radius portion; a second decreasing radius portion having a cam profile such that said each vane has an amount of protrusion from said rotor gradually decreasing and a receding velocity thereof gradually decreasing, as it moves along said second decreasing radius portion; a third decreasing radius portion having a cam profile such that said each vane has an amount of protrusion from said rotor gradually decreasing and a receding velocity thereof gradually increasing as it moves along said third decreasing radius portion; and a fourth decreasing radius portion having a cam profile such that said each vane has an amount of protrusion from said rotor gradually decreasing and a receding velocity thereof gradually decreasing as it moves along said fourth decreasing radius portion; said increasing radius portion, and said first, second, third and fourth decreasing radius portions each having a starting end and a terminating end, and being successively arranged in the order mentioned in said predetermined moving direction of said vanes, said first and second decreasing radius portions being at least in part located in a rotational angle region of said rotor where fluid pressure acting upon a portion of said each vane protruded from said rotor rapidly increases with movement of said each vane along the same region, whereby fluctuations in torque acting upon said rotor are restrained in said rotational angle region of said rotor;

said one cycle performing portion of said endless camming inner peripheral surface further includes: a first constant radius portion located between said increasing radius portion and said first decreasing radius portion, and along which the amount of protrusion of each vane from the rotor is kept substantially constant with movement of the rotor; a second constant radius portion located between said second decreasing radius portion and said third decreasing radius portion, and along which the amount of protrusion of each vane from the rotor is kept substantially constant with movement of the vane; and a third constant radius portion located at one of a location immediately preceding said increasing radius portion and a location immediately following said fourth decreasing radius portion in said predetermined moving direction of said vanes, and along which sealing is effected between said rotor and said pump housing; said first, second and third constant radius portions each having a starting end and a terminating end between which the same portion has a camming inner peripheral surface thereof kept at a distance from the center of the rotor, which is obtained by the following equation:

$$R_1 = Ro + Hb \quad (1)$$

$$R_2 = Ro + Hd \quad (2)$$

$$R_3 = Ro \quad (3)$$

where $R_1$ = the distance between the center of the rotor and the camming inner peripheral surface of the first constant radius portion, $R_2$ = the distance between the center of the rotor and the camming inner peripheral surface of the second constant radius portion, $R_3$ = the distance between the center of the rotor and the camming inner peripheral surface of the third constant radius portion, Ro = the radius of the rotor, Hb = the amount of protrusion of each vane from the rotor at the terminating end of the increasing radius portion, and Hd = the amount of protrusion of each vane from the rotor at the terminating end of the second decreasing radius portion.

27. The vane compressor as claimed in claim 26, wherein said increasing radius portion comprises a first portion having a cam profile such that said each vane has a protruding velocity thereof gradually increasing as it moves along said first portion, and a second portion having a cam profile such that said each vane has a protruding velocity thereof gradually decreasing as it moves along said second portion.

28. The vane compressor as claimed in claim 26, wherein at least one of said first and second portions of said increasing radius portion and said first, second, third and fourth decreasing radius portions has a cam profile such that the distance between the center of said rotor and the camming inner peripheral surface of said at least one portion varies along a quadratic curve.

* * * * *

UNITED STATES PATENT AND TRADEMARK OFFICE

CERTIFICATE OF CORRECTION

PATENT NO. : 4,501,537

DATED : February 26, 1985

INVENTOR(S) : Yutaka ISHIZUKA

It is certified that error appears in the above-identified patent and that said Letters Patent is hereby corrected as shown below:

COLUMN 8, line 15, before "Constant" change "Section" to --Second--;

COLUMN 15 (claim 8), line 54, change "temrinating" to --terminating--;

COLUMN 15 (claim 9), line 66, change "claims 1 and 2," to --claims 1 through 8--;

COLUMN 16 (claim 10), line 21, change "claims 1 and 2," to --claims 1 through 8--;

COLUMN 16 (claim 11), line 44, change "claims 1 and 2," to --claims 1 through 8--;

COLUMN 16 (claim 12), line 66, change "caims 1 and 2," to --claims 1 through 8--.

Signed and Sealed this

*Twenty-second* Day of *October 1985*

[SEAL]

*Attest:*

*Attesting Officer*

DONALD J. QUIGG

*Commissioner of Patents and Trademarks—Designate*